US008201481B2

(12) United States Patent
Williams

(10) Patent No.: US 8,201,481 B2
(45) Date of Patent: Jun. 19, 2012

(54) TACKING TOOL

(76) Inventor: Victor D. Williams, Salt Lake City, UT (US)

( * ) Notice: Subject to any disclaimer, the term of this patent is extended or adjusted under 35 U.S.C. 154(b) by 325 days.

(21) Appl. No.: 12/715,565

(22) Filed: Mar. 2, 2010

(65) Prior Publication Data

US 2011/0214536 A1 Sep. 8, 2011

(51) Int. Cl.
*B25C 3/00* (2006.01)
*B25C 7/00* (2006.01)

(52) U.S. Cl. ..... 81/44; 227/113; 227/146

(58) Field of Classification Search ..... 81/44; 227/113, 227/146, 147
See application file for complete search history.

(56) References Cited

U.S. PATENT DOCUMENTS 2,929,067 A * 3/1960 Tupta ..... 81/44
5,921,456 A * 7/1999 Kirsch et al. ..... 227/147
6,648,203 B2 * 11/2003 Lord ..... 227/147
6,871,568 B2 * 3/2005 Chen ..... 81/44
6,951,153 B2 * 10/2005 Berthlaume ..... 81/44
7,140,274 B2 * 11/2006 Foster ..... 81/27
2005/0126345 A1 * 6/2005 Berthiaume ..... 81/44
2006/0225342 A1 * 10/2006 Hamman ..... 47/1.01 F
2007/0051208 A1 * 3/2007 Stephens ..... 81/44
* cited by examiner

*Primary Examiner* — David B Thomas
(74) *Attorney, Agent, or Firm* — Webb IP Law Group; Jason P. Webb; Danny Y. H. Cheng

(57) ABSTRACT

There is a tool configured to tack a coupling device to a surface including a handle configured to permit a user to grasp the tool. The tool also includes a shaft member coupled to the handle and including a spring-loaded mechanism, configured to provide a force to tack a coupling device to a surface and to release the coupling device to the surface. In addition, the tool includes a head member coupled to the shaft member and configured to receive and hold a coupling device head in preparation for tacking. The head member includes a head body, a magnet disposed within the head body, and a socket member extending from the head body and including a curved socket bottom adjacent the magnet and a rim having a beveled cross-section; wherein the head member includes a gap between the magnet and the coupling device.

10 Claims, 5 Drawing Sheets

TACKING TOOL

BACKGROUND OF THE INVENTION

1. Field of the Invention

The present invention relates to quilting tools, specifically a tool configured to couple tack to a surface.

2. Description of the Related Art

Tacking is used in a variety of ways, such as to temporarily hold a seam or trim in place until it can be permanently sewn. This is done usually with a long running stitch made by hand or machine called a tacking stitch or basting stitch. To temporarily attach a lace collar, ruffles, or other trim to clothing so that the attached article may be removed easily for cleaning or to be worn with a different garment. For this purpose, tacking stitches are sewn by hand in such a way that they are almost invisible from the outside of the garment. The stitch is removed after the piece is finished. Tacking is often used in quilting or embroidery, to hold the material in place during manufacturing. Some improvements have been made in the field. Examples of references related to the present invention are described below, and the supported teachings of each reference are incorporated by reference herein:

U.S. Pat. No. 6,648,203, issued to Lord, discloses an upholstery tack holding tool is formed with a shaft having a concave gripping surface formed transversely into the shaft. The concave gripping surface terminates in a circumferential lip that encircles a longitudinally extending concave tack receiving area at one end of the shaft opposite the flat top surface adapted for striking by a tack hammer. The tools improves control, stability, and speed of operation by enabling the operator to simultaneously grasp the lip of the tool and the head of the tack to hold the tack against the concave tack receiving portion while being inserted into the desired surface.

U.S. Pat. No. 4,061,225, issued to Pettitt, discloses a tool for inserting thumb tacks comprising a handle having a neck-down portion near its one end with a recess in that end containing a magnet therein permitting picking up a thumb tack and holding it in a position for insertion, the neck-down portion of the tool permitting applying thumb pressure. The other end of the tool is rounded to allow application of additional pressure, if needed, with the heel of the hand. Also disclosed is a container for holding the thumb tacks in a manner that they can be easily picked up and also including a recess for the tool.

U.S. Pat. No. 4,709,765, issued to Campanell, discloses a device for automatically driving tacks and the like includes a plunger, a hammer element, a drive spring and a release pin which are assembled in a housing and cooperate to effect an impacting action when the outer end of the plunger is pressed against the head of a tack or the like. Specifically, when the head of the plunger is pressed against the head of a tack, the plunger is advanced into the housing to load the drive spring; and when the drive spring is fully loaded, the release pin releases the hammer element so that it is propelled into impacting engagement with the plunger to drive the tack or the like.

U.S. Pat. No. 5,098,003, issued to Young et al., discloses a fastener introduced into the barrel of the apparatus is received by a movable fastener retainer. The fastener is moved by a fastener positioning member to a ready to drive position prior to being driven from the outlet of the apparatus by a driver member. The shank of fastener in its ready to drive position extends generally parallel to the central axis of the barrel and its pointed free end preferably is adjacent the barrel outlet. A complete cycle of operation of the apparatus ensues in response to operator movement of a trigger of the apparatus.

U.S. Pat. No. 5,178,048, issued to Matechuk, discloses a fastener drivers modified by fastening a flexible strap of magnetic material adjacent the driving end of the tool. The fastener is retained on the tool by the magnetic force provided by the strap thus freeing the hands of the user. The strap may be conveniently adapted to a variety of driving tool.

The inventions heretofore known suffer from a number of disadvantages which include being difficult to use, being limited in adaptability, being limited in use, being limited in versatility, being too expensive, being bulky, being ineffective, and being inefficient.

What is needed is a tacking tool that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available tacking tools. Accordingly, the present invention has been developed to provide an efficient and effective tacking tool According to one embodiment of the invention, there is a tool configured to tack a coupling device to a surface. The tool may include a handle configured to permit a user to grasp the tool. The tool may also include a shaft member coupled to the handle. The shaft member may include a spring-loaded mechanism configured to provide a force to tack a coupling device to a surface and to release the coupling device to the surface. In addition, the tool may include a head member coupled to the shaft member and configured to receive and hold a coupling device head in preparation for tacking. The head member may include a head body and a magnet disposed within the head body. The head member may also include a socket member extending from the head body. The socket member may include a curved socket bottom adjacent the magnet and a rim having a beveled cross-section. The head member may also include a gap between the magnet and the coupling device. Furthermore, the head member may include a magnet inset into the head member. The handle member may include a covering member configured to provide a gripping surface. The head member may be selectably coupleable to the handle member. The head member may also be selectably adjustable. Moreover, the handle member may be selectably extendable.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
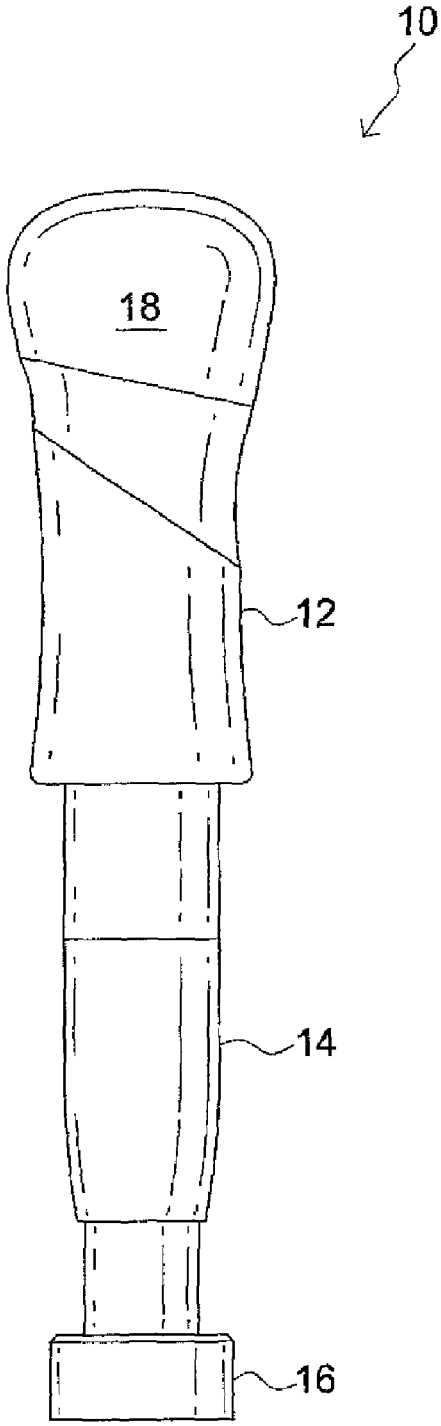
FIG. 1 is a side elevational view of a tacking tool, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a side elevational view of a tacking tool, according to one embodiment of the invention. There is a tool 10 configured to tack a coupling device to a surface. The tool 10 includes a handle 12 configured to permit a user to grasp the tool 10 during operation. The tool 10 also includes a shaft member 14 coupled to the handle 12. In addition, the tool 10 includes a head member 16 coupled to the shaft member 14 and configured to receive and hold a coupling device head in preparation for tacking. The handle member 12 includes a covering member 18 configured to provide a gripping surface.

In operation of one embodiment of the invention, a user picks up a tacking tool and disposes the tacking tool over a coupling device. The magnet inset into the head member of the tacking tool couples to the metal of the coupling device. The user disposes the coupling device over a material and tacking surface and presses down upon the handle of the tacking tool. The force from the tacking tool couples the coupling device to the tacking surface thereby securing the material in between.

Figure 2:
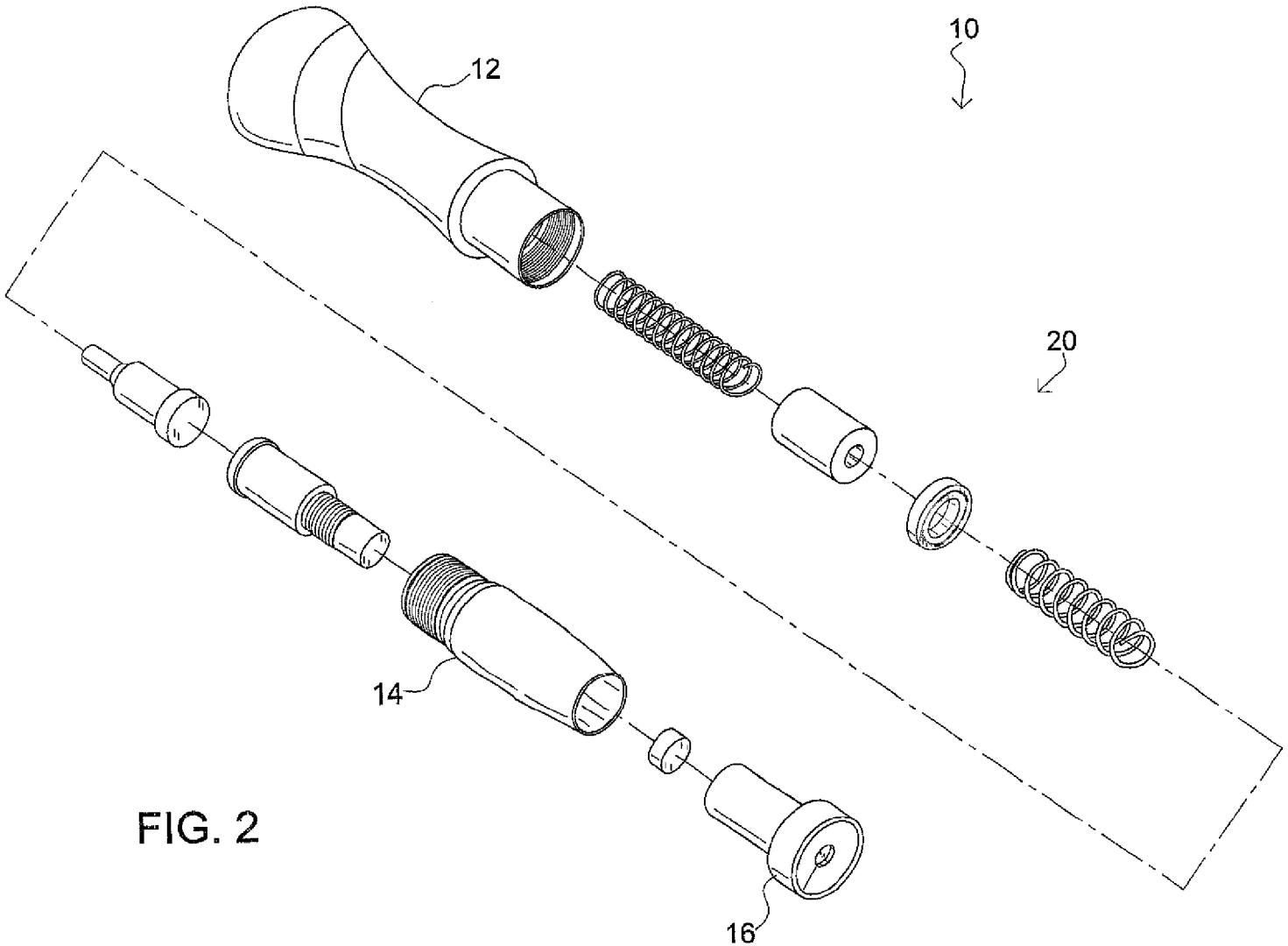
FIG. 2 is an exploded perspective view of a tacking tool, according to one embodiment of the invention.

FIG. 2 is an exploded perspective view of a tacking tool, according to one embodiment of the invention. There is a tool 10 configured to tack a coupling device to a surface. The tool 10 includes a handle 12 configured to permit a user to grasp the tool 10. The tool 10 also includes a shaft member 14 coupled to the handle 12. Encased in the shaft member 14, there is a spring-loaded mechanism 20 configured to provide a force to tack a coupling device to a surface and to release the coupling device thereon. In addition, the tool 10 includes a head member 16 coupled to the shaft member 14 and configured to receive and hold a coupling device head in preparation for tacking.

In operation of one embodiment of the invention, a user picks up a tacking tool and disposes the tacking tool over a coupling device. The magnet inset into the head member of the tacking tool couples to the metal of the coupling device. The user disposes the coupling device over a material and tacking surface and presses down upon the handle of the tacking tool. The force from spring loaded mechanism of the tacking tool couples the coupling device to the tacking surface thereby securing the material in between.

Figure 3:
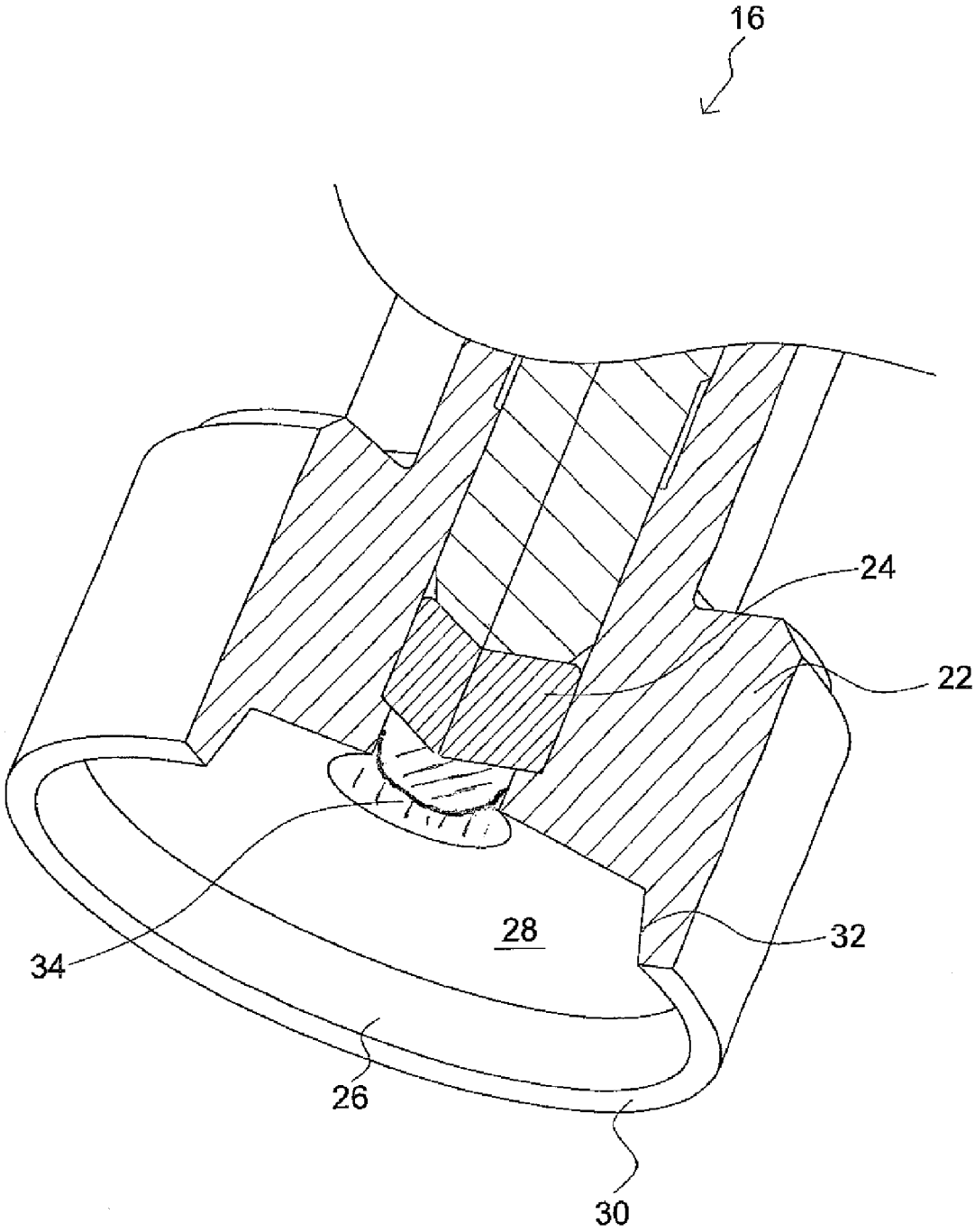
FIG. 3 is a perspective cross-sectional view of a head member of a tacking tool, according to one embodiment of the invention.

FIG. 3 is a perspective cross-sectional view of a head member of a tacking tool, according to one embodiment of the invention. There is a tool configured to tack a coupling device to a surface. The tool includes a head member 16 coupled to the shaft member and configured to receive and hold a coupling device head in preparation for tacking. The head member 16 includes a head body 22 and a magnet 24 disposed within the head body 22. The head member 16 also includes a socket member 26 extending from the head body 22. The socket member 26 includes a curved socket bottom 28 adjacent the magnet 24 and a rim 30 having a beveled cross-section 32. The head member 16 also includes a gap 34 between the magnet 24 and the coupling device. As illustrated in FIG. 3, the magnet 24 is inset into the head member 16.

In operation of one embodiment of the invention, a user disposes the head member of the tacking tool about a coupling device. The magnet inset into the head member couples to the metal of the coupling device. The beveled cross-section is configured to couple a coupling device including a plurality of various sized coupling devices.

Figure 4:
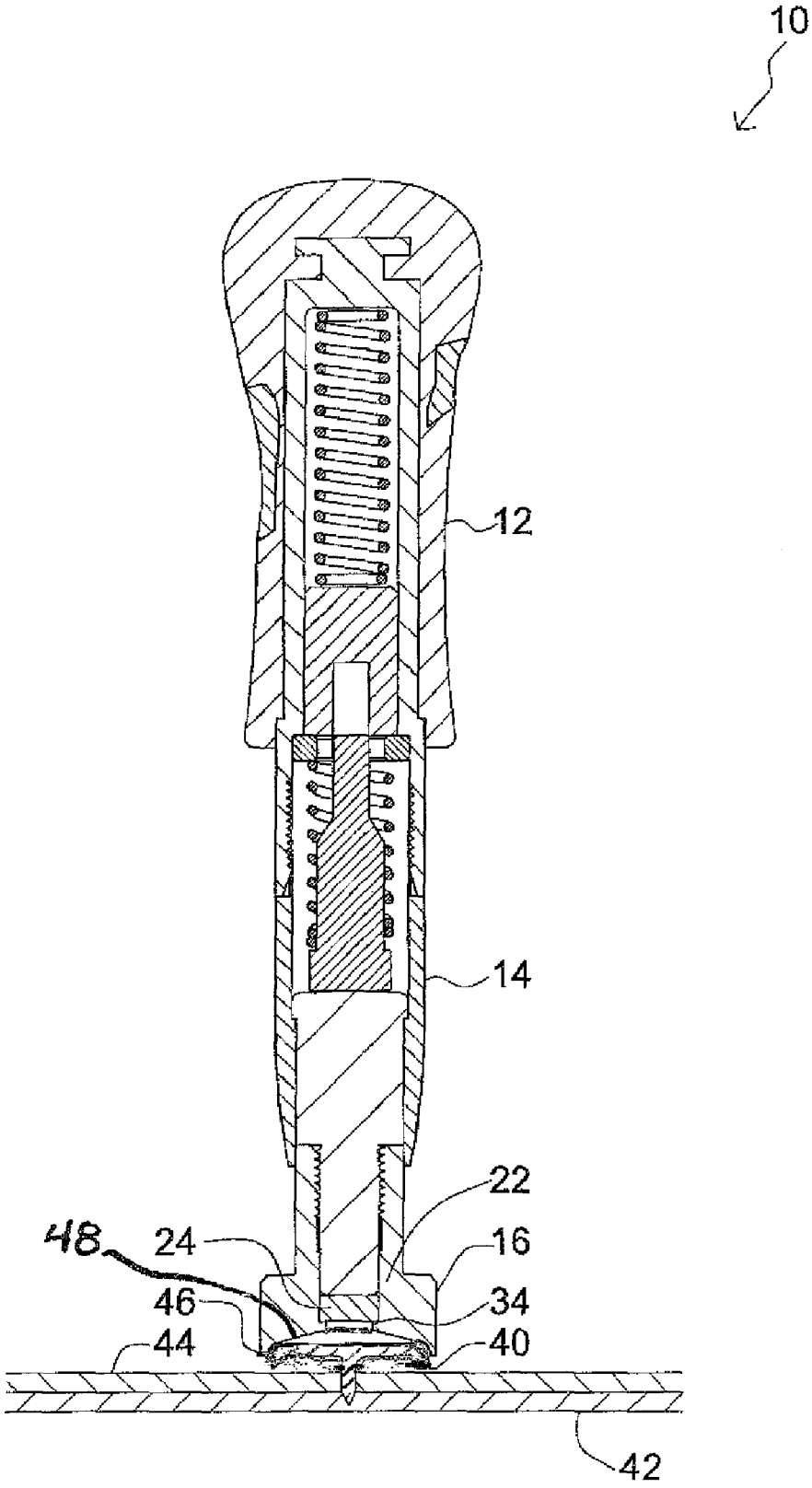
FIG. 4 is a side cross-sectional view of a tacking tool and a coupling device, according to one embodiment of the invention.

FIG. 4 is a side cross-sectional view of a tacking tool and a coupling device, according to one embodiment of the invention. There is a tool 10 configured to tack a coupling device 40 to a surface 42. The tool 10 includes a handle 12 configured to permit a user to grasp the tool 10. The tool 10 also includes a shaft member 14 coupled to the handle 12. The shaft member 14 includes a spring-loaded mechanism 20 configured to provide a force to tack the coupling device 40 to the surface 42 and to release the coupling device 40 to the surface 42, thereby tacking a material 44 thereto. In addition, the tool 10 includes a head member 16 coupled to the shaft member 14 and configured to receive and hold a coupling device head 46 in preparation for tacking. The head member 16 includes a head body 22 and a magnet 24 disposed within the head body 22. The head member 16 also includes a gap 34 between the magnet 24 and the coupling device 40.

Figure 5:
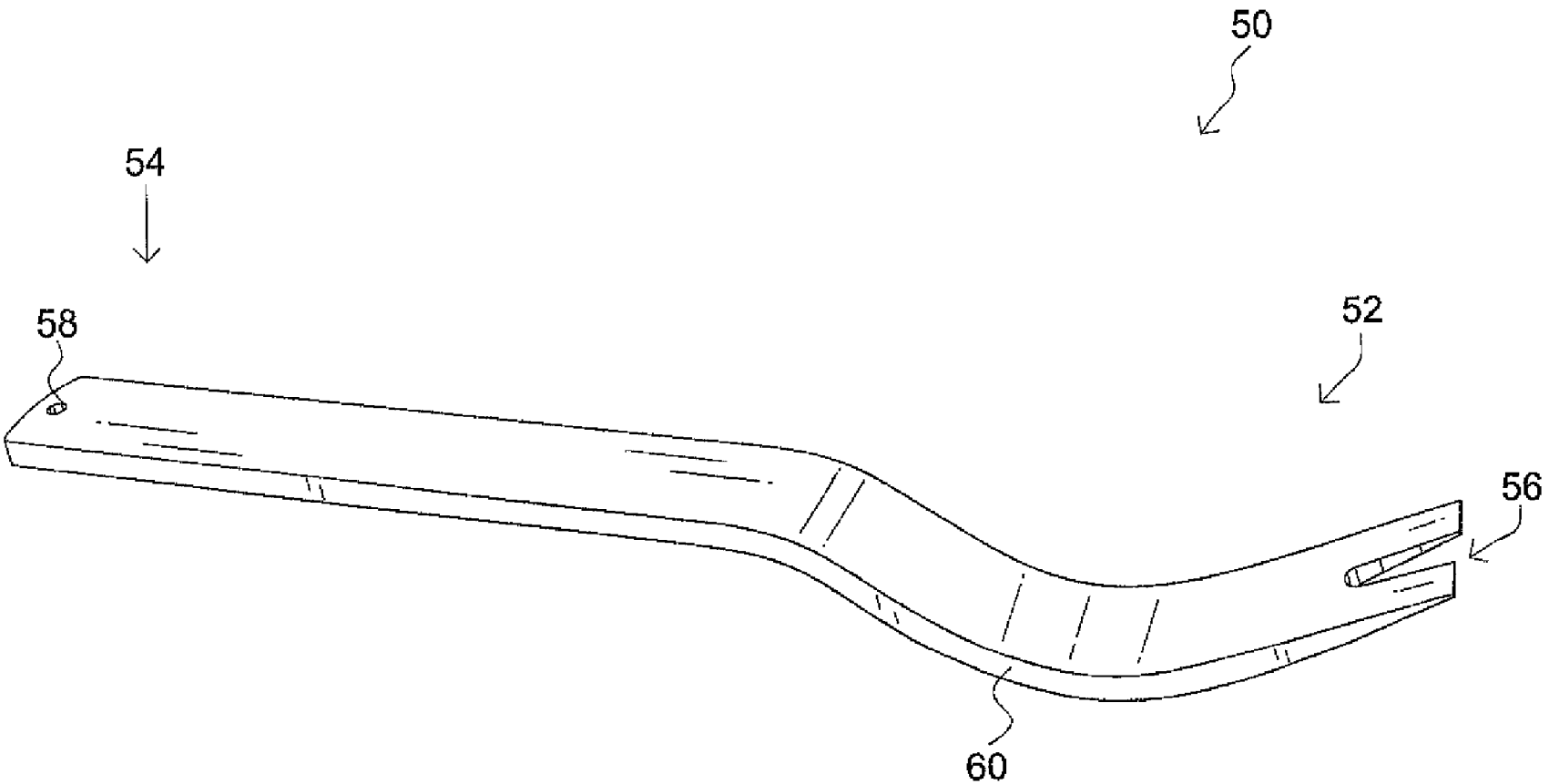
FIG. 5 is perspective view of a removal tool, according to one embodiment of the invention.

In addition, as illustrated in FIG. 4, the head member 16 includes a graduated well bottom 48. The graduated well bottom 48 is configured to facilitate sufficient distance between the inset magnet 24 and the coupling device 40. Furthermore, the inset magnet 24, the graduated well bottom 48, the a curved socket bottom 28 the rim 30, the beveled cross-section 32, and the gap 34 are configured to assist the head member couple to a variety of different coupling devices, varying in size, shape, design, configuration, length, width, height, FIG. 5 is perspective view of a removal tool, according to one embodiment of the invention. There is a removal tool having a first end 52 and a second end 54. The first end 52 includes a fork member 56 configured to decouple a coupling device from a material and taking surface. The second end 54 includes an aperture 58 configured to assist in straightening a bent coupling device. The removal tool 50 also includes a curved body member configured to create leverage to decouple the coupling device from the material and tacking surface.

In operation of one embodiment of the invention, a user slides the first end of a removal tool under a coupling device coupled to a tacking surface. The user pushes down about the second end of the removal tool, thereby releasing the coupling device from the tacking surface and uncoupling the material therefrom. The user also straightens a coupling device by positioning the bent configuration of the coupling device through the aperture and bending the coupling device into a straight configuration.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the illustrates a circular handle, one skilled in the art would appreciate that the handle may vary in size, shape, design, configuration, color, length, width, height, diameter, etc., and still perform its intended function.

Additionally, although the figures illustrate a head member, one skilled in the art would appreciate that the head member may be selectably removable and configured to secure various sized socket members and still perform its intended function.

It is envisioned that one skilled in the art would appreciate that the magnet inset into the head body, may vary in size, strength, diameter, shape, design, configuration, length, height, width, and still perform its intended function.

Finally, it is envisioned that the components of the device may be constructed of a variety of materials, such as but not limited to: plastics, plastic composites, rubber, rubber composites, metal, metal alloys, carbon fiber, glass, textiles, etc. and still perform its intended function.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A tool configured to tack a coupling device to a surface, comprising:

a) a handle, configured to permit a user to grasp the tool;

b) a shaft member coupled to the handle and including a spring-loaded mechanism, configured to provide a force to tack a coupling device to a surface and to release the coupling device to the surface; and c) a head member coupled to the shaft member and configured to receive and hold a coupling device head in preparation for tacking, including:

a head body;

a magnet disposed within the head body;

a socket member extending from the head body and including a curved socket bottom adjacent the magnet and a rim having a beveled cross-section; wherein the head member includes a gap between the magnet and the coupling device.

2. The tool of claim 1, wherein the head member includes a magnet inset into the head member.

3. The tool of claim 1, wherein the handle member includes a covering member configured to provide a gripping surface.

4. The tool of claim 1, wherein the head member is selectably coupleable to the handle member.

5. The tool of claim 1, wherein the head member is selectably adjustable.

6. A tool configured to tack a coupling device to a surface, comprising:

a) a handle, configured to permit a user to grasp the tool;

b) a shaft member coupled to the handle and including a spring-loaded mechanism, configured to provide a force to tack a coupling device to a surface and to release the coupling device to the surface; and c) a head member coupled to the shaft member and configured to receive and hold a coupling device head in preparation for tacking, including:

a head body;

a magnet disposed within the head body;

a socket member extending from the head body and including a curved socket bottom adjacent the magnet and a rim having a beveled cross-section; wherein the head member includes a gap between the magnet and the coupling device; wherein the head member includes a magnet inset into the head member.

7. The tool of claim 6, wherein the handle member includes a covering member configured to provide a gripping surface.

8. The tool of claim 7, wherein the head member is selectably coupleable to the handle member.

9. The tool of claim 8, wherein the head member is selectably adjustable.

10. A tool configured to tack a coupling device to a surface, comprising:

a) a handle, configured to permit a user to grasp the tool; wherein the handle member includes a covering member configured to provide a gripping surface;

b) a shaft member coupled to the handle and including a spring-loaded mechanism, configured to provide a force to tack a coupling device to a surface and to release the coupling device to the surface; and c) a head member coupled to the shaft member and configured to receive and hold a coupling device head in preparation for tacking, including:

a head body;

a magnet disposed within the head body;

a socket member extending from the head body and including a curved socket bottom adjacent the magnet and a rim having a beveled cross-section; wherein the head member includes a gap between the magnet and the coupling device; wherein the head member includes a magnet inset into the head member; wherein the head member is selectably coupleable to the handle member; wherein the head member is selectably adjustable.

* * * * *